United States Patent [19]

Strimple et al.

[11] 4,269,397

[45] May 26, 1981

[54] METHOD FOR MEASURING THE THICKNESS OF A REFRACTORY IN A METALLURGICAL APPARATUS

[75] Inventors: Robert A. Strimple, Coopersburg, Pa.; Joseph E. Snyder, Forest, Va.; Bruce F. Shoemaker, Bethlehem, Pa.

[73] Assignee: Bethlehem Steel Corporation, Bethlehem, Pa.

[21] Appl. No.: 166,274

[22] Filed: Jul. 7, 1980

Related U.S. Application Data

[63] Continuation-in-part of Ser. No. 69,438, Aug. 24, 1979, abandoned.

[51] Int. Cl.[3] ..... C21B 5/00

[52] U.S. Cl. ..... 266/44; 266/99; 174/102 P; 73/86; 324/65 CR; 324/58.5 B

[58] Field of Search ..... 266/99, 44; 174/102 P, 174/304 R; 73/87.7; 324/65 CR, 58.5 B

[56] References Cited

U.S. PATENT DOCUMENTS

| | | | |
|---|---|---|---|
| 2,805,272 | 9/1957 | Postal | 136/228 |
| 2,915,305 | 12/1959 | Craig | 73/86 |
| 3,015,950 | 1/1962 | Doctor et al. | 73/86 |
| 3,018,663 | 1/1962 | Dunlop | 73/341 |
| 3,307,401 | 3/1967 | Backman | 73/359 |
| 3,836,402 | 9/1974 | Zysk et al. | 136/236 |
| 3,938,385 | 2/1976 | Horwath | 324/58.5 B |

FOREIGN PATENT DOCUMENTS

| | | | |
|---|---|---|---|
| 1950939 | 5/1970 | Fed. Rep. of Germany | 174/102 P |
| 839,393 | 1/1939 | France | 174/102 P |
| 1431629 | 1/1966 | France | 174/102 P |
| 2528662 | 11/1968 | Japan | 324/65 CR |

OTHER PUBLICATIONS

Shiraiwa et al., *Tetsu-to-Hagane*, v. 61, 1975, n. 4, p. 44.

*Primary Examiner*—M. J. Andrews

*Attorney, Agent, or Firm*—Joseph J. O'Keefe; Charles A. Wilkinson; John S. Simitz

[57] ABSTRACT

A method for measuring the thickness of a refractory laid-up against the interior surface of the steel shell of a metallurgical apparatus includes placing at least one monitoring device in a critical wear area of the apparatus in a manner such that the free end of the device is at a known distance from the hot face of the refractory and the confined end extends beyond the outer surface of the steel shell. The device is connected to an electronic time-domain reflectometer by electrical connecting means. Timed pulses are generated and impressed in the device by the instrument and reflections of the pulses are received by and are visually displayed on the reflectometer. The length of the device appears on the display as a straight line bounded by two inflections. The straight line is indicative of the thickness of the refractory.

The device includes a metallic conductor coaxial with an outer metallic sheath and separated therefrom by a refractory having a desired dielectric constant. The device has a free end and a confined end. The confined end may be contained in a junction box provided with electrical connecting means. Electric insulating packing may be used in the junction box.

26 Claims, 3 Drawing Figures

METHOD FOR MEASURING THE THICKNESS OF A REFRACTORY IN A METALLURGICAL APPARATUS

CROSS-REFERENCES TO RELATED APPLICATIONS

This application is a continuation-in-part of application Ser. No. 69,438 filed Aug. 24, 1979 now abandoned in the name of Robert A. Strimple et al, and entitled "A Device and Method for Continuously Monitoring the Thickness of Refractory Lining Metallurgical Furnaces."

BACKGROUND OF THE INVENTION

This invention is directed to a method for measuring the thickness of a refractory in metallurgical apparatus, and more particularly to measuring the thickness of a refractory laid-up against the interior surface of the steel sheel of a metallurgical apparatus, for example a blast furnace, electric arc furnace, basic oxygen furnace, etc. The device used to measure the thickness of the refractory is also described.

Apparatus, for example, metallurgical furnaces and mobile hot metal transport, for example blast furnaces, basic oxygen furnaces, electric arc furnaces, open hearth furnaces, submarine ladles, stationary hot metal mixers, glass refining furnaces, power house boilers and the like, are constructed of a steel superstructure or steel shell and a refractory supported by the superstructure or laid-up against the interior surface of a steel shell. The refractory confines the heat and hostile atmosphere within the apparatus and protects the surrounding environment and/or steel superstructure and steel shell of the apparatus.

In recent years, much effort has been expanded to develop improved refractory. These efforts have resulted in an increase in the life of the refractory and have increased the length of furnace campaigns, i.e., the time a furnace is in service before a reline of refractory is required. Such efforts are continuing since the longer the time a furnace is in operation the fewer relines are required and the lower is the cost of producing molten metals in the furnace. Many of these efforts have been directed to monitoring the wear or erosion of the refractory so that timely repairs can be made to the refractory to prolong the campaign of the furnace and to prevent catastrophic failures of the refractory.

Several devices and methods for monitoring the wear of the refractory in metallurgical furnaces are disclosed in U.S. Pat. No. 3,078,707 to L. G. Weaver entitled "Thickness Gage for Blast Furnace Wall", U.S. Pat. No. 3,307,401 to G. S. Bachman entitled "Element for Measurement of Furnace Wall Thickness and Temperature", U.S. Pat. No. 3,532,797 of H. K. Lunig entitled "Apparatus for Monitoring Thickness of Wall Lining of Electric Arc Furnace" and U.S. Pat. No. 3,512,413 to O. VonKrusenstierna et al. entitled "Measuring Body Capable of Being Built into the Wall of a High Temperature Furnace". All the monitoring devices disclosed in the above patents are essentially thermocouples having two dissimilar metals. The devices operate on the principle of electrical resistance masurements and rely on the discontinuity of an electric circuit. Bachman and Weaver use "ladder-like" devices extending through the thickness of the refractory while Lunig and Krusenstierna et al. rely on a plurality of paired resistance wires of various lengths positioned at various depths in the refractory thickness. In actuality the monitoring devices do not continuously monitor the thickness of the refractory in the sense that a direct thickness measurement is made continuously. The thickness of the refractory is actually known, or determined, only at the time of a disruption in the electric circuit and is only approximately known when the circuit is again completed.

The prior art devices enumerated above are limited to measuring fixed thicknesses that are dependent upon the position of a particular wire or loop in the refractory. These types of devices are also susceptible to being "shorted-out" by slag penetration, breakage due to spalling of the refractory, and deterioration of the sheath and insulating material placed between the wires and the sheath. Then, too, the number of refractory surface positions or thicknesses of refractory which can be measured by these devices is finite. For each new position, a separate wire or loop must be added to the monitor body.

Another method for measuring the thickness and monitoring the wear of the refractory is the use of sources of low level radiation, i.e. radioactive isotopes. A plurality of the sources are embedded at predetermined locations in the refractory during reline. When a source ceases to emit radiation, erosion at that location is indicated. Since the actual erosion is known only when radiation ceases, it can be seen that this device and method are similar to the other devices and methods in that the thickness and erosion of the refractory is not known until the source disappears. Radiation type monitoring is thus not really a continuous measurement system. Handling of the radioisotopes must furthermore be done by specially trained and licensed personnel. If any isotopes remain in the refractory after a furnace campaign, special care must be taken by the licensed personnel to recover the isotopes.

There is therefore a need for an inexpensive, safe, substantially continuous method for measuring the thickness of a refractory in a metallurgical apparatus particularly while the apparatus is in service.

It is an object of this invention to provide a method for measuring the thickness of the refractory in a metallurgical apparatus, for example a blast furnace, basic oxygen furnace or electric furnace, etc. wherein at least one monitoring device is positioned in a critical wear area of the refractory laid-up against the interior surface of the steel shell of the apparatus and the device is connected to an electronic instrument which induces timed pulses in the device and records and displays reflected signals of the impulses, which display is indicative of the length of the device and thickness of the refractory.

It is also an object of this invention to provide a simple monitoring device suitable for use with an electronic instrument which uses the time-domain reflectometry techniques, whereby the thickness of the refractory can be measured either continuously or intermittently.

SUMMARY OF THE INVENTION

According to this invention, there is provided a method for measuring the thickness of a refractory laid-up against the interior surface of the steel shell of a metallurgical apparatus, for example, a blast furnace, an electric furnace, a basic oxygen furnace, etc. The method includes the use of at least one monitoring device laid-up in a selected critical wear area of the furnace. The monitoring device is comprised of a central metallic conductor and an outer metallic sheath separated from the conductor by a pulverulent close-packed insulating material having a desirable dielectric constant. The device has two ends, a free end and a confined end. The confined end may be confined in a junction box and be connected to an electrical connector means attached thereto or may be connected directly to the electrical connector means by which the device is connected to an electronic instrument which uses time-domain reflectometry techniques. If confined in a junction box, an electrical insulating packing of desired dielectric constant may be used to prevent dirt, dust or moisture from ingress into the box. The device erodes at substantially the same rate as the refractory during service. In the method of the invention, the free end of the device is placed at a known distance from the hot face of the refractory while the confined end, attached to an electrical connector means, extends beyond the cold face of the refractory. The device is connected by means of the electrical connector means to an electronic instrument, for example a time-domain reflectometer (TDR) capable of generating and sending stepped, timed voltages or pulses through the device and receiving reflected pulses or echoes which are visually displayed. The resultant picture or signature of the reflected pulses is indicative of the length of the monitoring device which in turn is indicative of the thickness of the refractory.

FIGURES OF THE INVENTION

PREFERRED EMBODIMENT OF THE INVENTION

Figure 3:
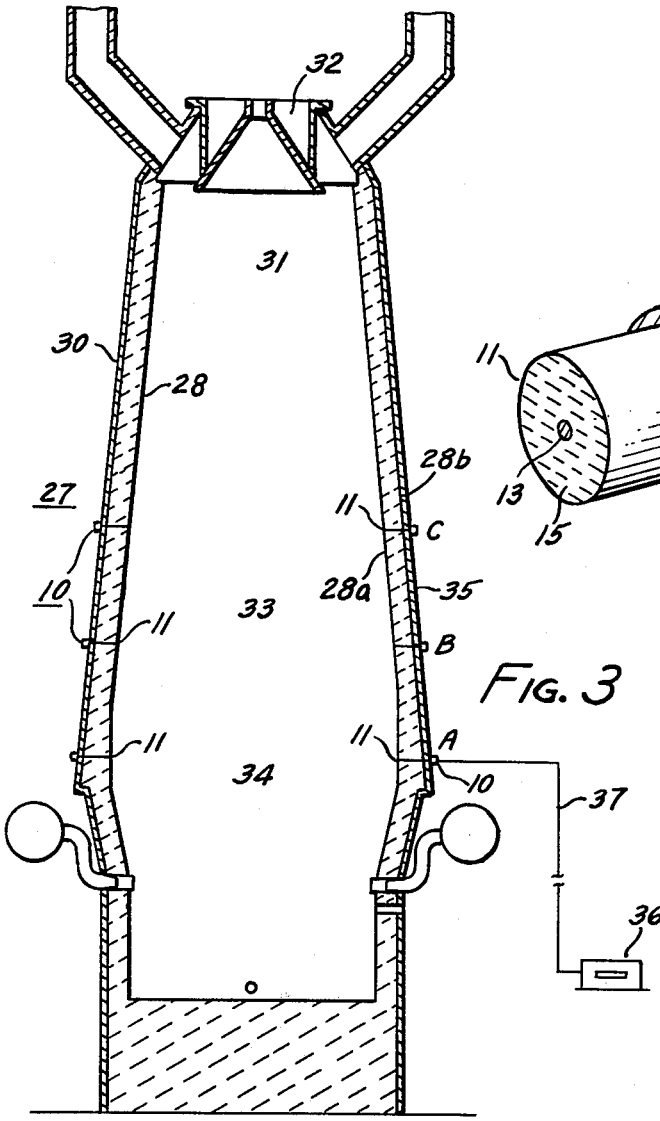
FIG. 3 is a schematic diagram of a blast furnace showing a plurality of the monitoring devices of the invention at several vertically spaced critical wear areas in the refractory laid-up against the interior surface of the steel shell of the furnace.

According to the invention, there is provided a method for measuring the thickness of a refractory which is laid-up against the interior surface of the metallic shell of a metallurgical apparatus, for example a blast furnace, basic oxygen furnace, electric arc furnace, etc.

In the method, at least one monitoring device is positioned at a critical wear area in the refractory. The device is comprised of a central metallic electrical conductive conductor coaxial with a metallic electrical conductive sheath and separated therefrom by a closely packed pulverulent electrical insulating refractory. The device has two ends, one free or exposed end and one confined end, each of which is generally a flat surface. The confined end is connected to an electrical connecting means. The free end is positioned at a known distance from the hot face of the refractory. The hot face of the refractory is the face or surface of the refractory which is exposed to the hot, hostile environment in the apparatus. The device extends approximately perpendicular to the hot face of the refractory through the body of the refractory and the confined end extends a known distance beyond the cold face of the refractory and the exterior surface of the shell of the apparatus. The cold face of the refractory is that face of the refractory which is substantially parallel to the hot face and spaced therefrom by the body of the refractory. The cold face is not actually "cold" but since it is the face of the refractory furthest from the environment in the apparatus and is protected from the hot environment by the bulk of the refractory and other refractory, it is generally at a lower temperature than is the hot face of the refractory.

The confined end, so called because it may be confined in a junction box, of the device is connected to an electronic instrument by means of a coaxial cable extending from the electrical connector means to the instrument. The electronic instrument is a time-domain reflectometer which uses pulse reflectometry techniques. The instrument generates ultra-fast rise time voltage steps or pulses which are propogated through the monitoring device. A portion of the energy in the pulses is reflected back to the instrument by physical features of the device. The reflected energy is detected by the reflectometer and is visually displayed on an oscilloscope or cathode ray tube or like display. The visual display may appear as an inflection, that is, either a rise or a fall, or as a substantially straight line. In the invention, the reflected energy from a first interface which is formed by the capacitor comprised of the conductor and the sheath and an air separator in the junction box appears as an upward inflection on the display and is used as a reference point in determining the length of the monitoring device. All points along the device from the confined end to the free end reflect an equal portion of the energy in the pulses and their reflections are displayed as a straight line. A portion of the energy reflected by a second interface formed by the free end surface of the device and the atmosphere in the furnace appears either as an upward or downard inflection on the cathode ray tube but in either case shows the termination of the monitoring device. The straight line displayed between the first and second interfaces is substantially the length of the monitoring device. The reflection from the free end surface of the monitor will occur regardless of its electrical conductivity, i.e., the reflection will occur if the conductor is electrically insulated from, completely shorted or partially shorted to the sheath or the hot face of the refractory which conditions adversely affect other types of two-wire monitors.

Figure 1:
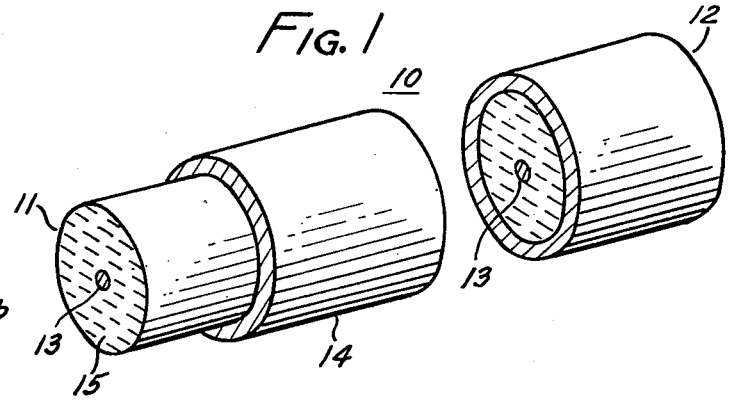
FIG. 1 is an enlarged isometric view of the monitoring device of the invention.
Figure 2:
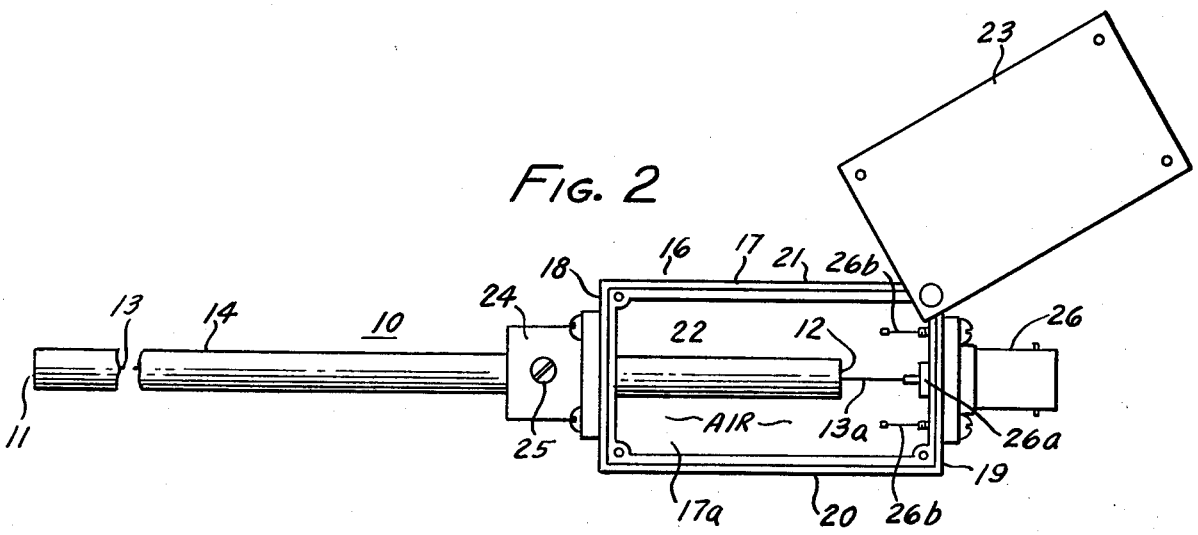
FIG. 2 is a longitudinal view of the monitoring device of the invention.

The preferred embodiment of the monitoring device is shown in FIGS. 1 and 2. As shown in FIGS. 1 and 2, the monitoring device 10 is of any predetermined length, that is, the monitoring device can be any length, for example, up to about 61 meters or more commensurate with the thickness of the refractory, and the thickness of the supporting structure of the apparatus to be monitored. The device is comprised of a metallic conductor 13 coaxial with a metallic sheath 14 and separated therefrom by a pulverulent closely-packed insulating refractory material 15 having a known suitable dielectric constant. The distance between the conductor and sheath is essentially the same the entire length of the device. The suitability of the dielectric constant is dependent upon the relative sizes of the conductor 13 and the sheath 14 and the impedance necessary for correct operation of the particular electronic instrument (not shown) to which the device is connected. The monitoring device 10 terminates in two generally flat surfaces, ends 11 and 12. End 11 will hereinafter be referred to as the free or exposed end and end 12 will hereinafter be referred to as the confined end (shown in FIG. 2). A small portion 13*a* of the conductor 13 extends beyond end 12 of the sheath 14 at confined end 12 and may be separated therefrom by air which has a dielectric constant different from the electric constant of the insulating refractory material 15. The conductor 13 and sheath 14 are shown as being generally circular in cross-section, however, the conductor and sheath may be of any shape in cross-section as long as the distance between the outer surface of the conductor and the inner surface of the sheath remains constant substantially the entire length of the device. If the distance between the conductor and sheath should vary significantly, the impedance of the device will vary and false reflections or echoes will be created and appear on the electronic instrument. Minor discontinuities along the device can be tolerated so long as such discontinuities do not reflect all the energy on the pulses and are calibrated or accounted for in reading the display on the electronic instrument.

The confined end 12 of the monitoring device 10 may be contained in a junction box 16 of the shape shown. Such shape is shown by way of example only, since other tupes and shapes of junction boxes may be used. The junction box 16 is of a one-piece cast metal construction forming a generally rectangularly shaped box 17 having an open top 17*a* and integral end walls 18 and 19, side walls 20 and 21, and bottom 22. A cover plate 23 is fastened as shown to close the box. A bracket 24 having an axial aperture (not shown) and a set screw 25 extending into the aperture is fastened to end wall 18 as shown. The aperture in the bracket is aligned with an aperture (not shown) in end wall 18 whereby confined end 12 of the monitoring device 10 can be inserted into the box 17 as shown. The monitoring device 10 is firmly clamped in place by tightening set screw 25. A female BNC connector 26 is fastened by appropriate means to end wall 19 with portions 26*a* and 26*b* extending through appropriate openings (not shown) in the end wall 19 as shown. The conductor 13 and the sheath are connected by any well known means to connector 26 as shown. A coaxial cable (shown at 37 in FIG. 3) is attached to the connector 26 and connects the device 10 to a time-domain reflectometer (shown diagrammatically at 36 in FIG. 3). The reflectometer can be a Tektronik 1502TDR manufactured by Tektronix, Inc., P.O. Box 500, Beaverton, Oregon 97077, or suitable instrument which can be used with the device of the invention to measure the thickness and monitor the erosion of the refractory. If it is desired, confined end 12 may be connected directly to the connector 26, without being confined in junction box 16 thereby simplifying the construction of the device 10 without adversely affecting its accuracy.

The junction box may be packed with an electrically insulating material (not shown) having a desired dielectric constant, for example silicone rubber produced by Dow Corning Corporation, Midland, Mich. 48640 and sold commercially as Silicone Rubber clear sealant prior to placing the cover 23 atop the box. The sealant protects the confined end and electrical connections in the box from dust, dirt and moisture. The box may not contain any sealant so long as the cover 23 fits tightly onto the box to prevent the ingress of dirt, dust or moisture. In the latter case, air is used as the insulating material and the dielectric constant of air is known. It is preferred to pack the box with a sealant of the type mentioned above.

As noted previously, the end 12 may not be confined in a junction box but may be connected directly to an electrical connector means, however it is preferred to confine the end 12 in the junction box 16.

The conductor 13 and sheath 14 are made from any metal which will be electrically conductive and will withstand the hostile environment prevalent in metallurgical apparatus, for example a blast furnace, basic oxygen furnace or an electric furnace. Materials which can be used are 304 grade stainless steel, molybdenum, iron, platinum, tungsten and nickel-base alloys. Nickel-base alloys which contain manganese and aluminum or chromium or chromium and silicon and cobalt as described on pages 15 and 58–59, respectively, in *Handbook of Material Tradenames* by Zimmerman and Lavine, 1965, can be used as the conductor in the device. It is preferred to use molybdenum for the conductor and 304 grade stainless steel for the sheath. The conductor may be solid or hollow and may be about 10 gage in size or may be larger in severe applications requiring more body and 24 gage or smaller in applications in which space is limited. However, for practical purposes it is preferred that the size of the conductor be within a range between about 12 and 22 gage. In these specifications all wire sizes are American Wire Gage.

The refractory 15 can be any refractory which is electrically insulative, such as high purity alumina, high duty fireclay, mullite, sillimanite, magnesia, calcined calcium carbonate, calcined dolomite, calcined dolomitic limestone, zirconia and the like, so long as it is compatible with the refractory of the metallurgical apparatus. It is preferred to use high purity alumina in most applications but other refractories, such as magnesia or zirconia may also be used.

The dielectric constant of the refractory must be compatible with the construction of the monitor device and the electrical characteristics of the time-domain reflectometer. For example, the impedance of the monitor device must be correct for the TDR apparatus used. The impedance of the monitor is dependent upon the capacitance between the conductor and the sheath. Capacitance is dependent in turn upon both the distance between the plates of the capacitor, the size of the plates and the dielectric material between the plates. Thus, in order to provide any given capacitance the dielectric constant of the refractory material must be balanced against the relative size of the conductor 13 and the conductive sheath 14. Very small monitor dimensions may require a refractory having a dielectric constant dissimilar to that of a larger monitor in order to attain the most effective impedance for the TDR apparatus used. The time domain reflectometer is not the exclusive system which can be used in the invention, however, we prefer to use the time domain reflectometer since it is the simplest and easiest means for transmitting and recording (displaying) reflections or echoes.

It is preferred that confined end 12 of the monitor 10 extend beyond the refractory a significant distance since the construction of the monitor is heat resistant and sturdy. Confined end 12 could be positioned substantially at the cold face of the refractory, but this would result in the junction box and connections being exposed to both excessive heat and dirt. (As noted previously, the cold face is not really cold but in most cases relatively cold when compared to the temperature of the hot face.) The monitoring device can conveniently extend beyond the shell of the apparatus to remote locations and can even be bent around curves to more accessible less rigorous or more centralized locations without interfering with the reflected signals received therefrom. In such cases, the reading of the length of the monitor after refractory wear is merely subtracted from the initial reading of the length of the monitor to find the extent of refractory wear. Alternatively, a discontinuity can be introduced into the monitoring device at the cold face of the refractory so that the exact length of the refractory can be directly monitored at all times. Such a discontinuity could consist of a significant crimp in the sheath or an energy reflecting surface within the monitor, for example, a reflective surface comprised of the interface between one dielectric material and another disposed in the space between the conductor 13 and the outer conductive sheath 14. In one version of such a monitoring device the electrically insulating refractory material 15 could be arranged to be disposed between the conductor 13 and the sheath 14 only in the portion of the monitor extending from the hot face to the cold face of the original refractory, while the conductor and the sheath extend farther beyond the cold face of the refractory to some convenient location with only an air dielectric between them. In this instance, however, the monitor must be made especially for every original wall thickness of refractory in which it is to be mounted. It is more convenient and efficient, therefore, to form monitoring devices having a convenient length and subtract the length visually displayed upon the cathode ray tube of the TDR apparatus after operation of the refractory apparatus from the originally displayed length at the initiation of operation to determine the thickness of the refractory.

To illustrate the method of measuring the thickness and the erosion of the refractory laid-up against the interior surface of the steel shell in a blast furnace, a plurality of the monitoring devices 10 are shown in FIG. 3 positioned in the critical wear areas of the refractory 28 of the blast furnace 27. The monitoring devices 10 are positioned such that each of the exposed ends 11 are flush with the hot face 28*a* of the refractory 28. The hot face of the refractory is that face which is exposed to the hostile environment in the furnace. The cold face 28*b* of the refractory is parallel to the hot face and is laid-up against the interior surface of the metallic shell of the furnace. The devices 10 are positioned substantially perpendicular to the hot face of the refractory 28. The confined ends 12 extend beyond the outer surface 35 of the shell 30. The refractory 28 in the upper stack 31 of the furnace does not generally fail during a campaign because it is exposed only to abrasion caused by making contact with the raw materials used to produce molten iron as they are charged into the top 32 of the furnace. The refractory in the upper stack 31 is subjected to relatively low temperatures and hence it is not essential to monitor the erosion of the refractory in this area.

The refractory in the lower stack 33 and bosh 34, on the other hand, is exposed to excessively high temperatures, liquified slag, molten iron, a reducing atmosphere and noxious gases present in the furance environment. The refractory can and does wear rapidly in these critical wear areas so several monitoring devices are positioned at the 18.85 meter level identified as A; at the 20.98 meter level identified as B; and at the 23.11 meter level identified as C, as shown in FIG. 3, and spaced 90° apart. Each of the confined ends may be connected sequentially to a time-domain reflectometer 36 by a coaxial extension cable 37.

Each of the monitoring devices may be made from a swageable assembly of a 20 gage molybdenum conductor positioned in a prefired tube of high purity alumina having an outside diameter of 6.02 mm and an inside diameter of 1.96 mm which is inserted into a 304 grade stainless steel tubular sheath having an outside diameter of 7.899 mm and a wall thickness of 0.635 mm. The assembly is swaged down to a device which has an outside diameter of 6.35 mm. During the swaging operation, the prefired alumina tube is fractured and broken into many small particles which are pressed into a closely packed structure separating the conductor and the sheath.

The monitoring device can also be used in critical wear areas, for example at the slag line in the refractory on the interior surface of the steel shell of a basic oxygen furnace to monitor the erosion of the refractory. The insulating refractory of the monitoring device in this case can be a densely packed refractory other than alumina such as magnesia, or can be alumina.

Since the monitoring device is laid-up within the refractory, it is protected from the hostile environment in the furnace. As the refractory in the furnace erodes, the exposed end 11 of the monitoring device also erodes at substantially the same rate as the refractory. The loss in length of the monitoring device is substantially equal to the loss or the refractory i.e., the erosion or loss in thickness of the refractory. Since the original thickness of the refractory and the position of exposed end 11 of the monitoring device in the refractory are known, the thickness of the refractory can be deduced at any time from the length of the monitoring device visually displayed on the recording instrument. This is accomplished by subtracting the displayed length of the monitoring device from the original displayed length determined along with a suitable calibration of the recording instrument and in turn subtracting the difference found from the known thickness of the original refractory.

A monitoring device of the invention as shown in FIG. 2 was positioned experimentally in a critical wear area of a 170 ton electric furnace during reline of the furnace. The refractory of the furnace was comprised of tar-bonded, tempered magnesia shapes having a thickness of 34.29 cm. The monitoring device used in the furnace was 111.76 cm long and had a molybdenum conductor which was 0.737 mm in diameter, an alumina refractory having a dielectric constant of between 4.5 and 8.4 and a 304 stainless steel sheath having an inside diameter of 4.85 mm and an outside diameter of 6.35 mm. End 11 was aligned flush with the hot face of the refractory. End 12 extended beyond the steel shell of the furnace and was connected to a TDR 1502, which is a commercially available time-domain reflectometer. The thickness of the refractory was measured and the erosion monitored during the campaign of the furnace. The actual length of the monitoring device was 111.76 cm and the refractory thickness was 34.29 cm, hence 77.47 inches) of the monitoring device extended beyond the refractory through the shell of the furnace. The signature on the visual display of the electronic instrument was adjusted to show the actual thickness 34.29 cm of the refractory. During the furnace campaign a total of 126 heats, i.e., about $15.42\times10^{+4}$ kg of steel per heat produced from one furnace charge, of steel were refined and the furnace taken out of service for reline. A partial listing of the erosion of the refractory during the furnace campaign is shown below:

| | Measured Wall Thickness (Actual) (cm) | Monitor Length (cm) | Calculated Wall Thickness (cm) |
|---|---|---|---|
| At start | 34.3 | 111.8 | 34.3 |
| 44 Heats | — | 99.7 | 22.2 |
| 104 Heats | — | 88.3 | 10.8 |
| 126 Heats | 5.4 | 82.6 | 5.1 |

It can be seen that the final actual thickness of the refractory was only about 3 mm thicker than that visually recorded on the instrument.

While we have shown and described the use of the monitoring device of the invention in metallurgical furnaces which are comprised of a steel shell and a refractory laid-up in the interior of the shell to protect the shell from the hostile environment therein, the monitoring device can also be used in apparatus such as open hearth furnaces, glass refining furnaces, power house boilers, mobile hot metal transfer cars or submarine ladles, hot metal mixers and holding ladles and the like.

If it is desirable to monitor the thickness of the refractory in a working furnace, appropriate ports suitable for inserting the monitoring device of the invention can be formed in the shell and refractory by drilling and device inserted into the aperture so formed.

We claim:

1. In an improved method for measuring the thickness of a refractory laid-up against the interior surface of the steel shell of a metallurgical apparatus comprising:

(a) placing at least one monitoring device of predetermined length comprised of a central metallic conductor coaxial with a metallic sheath and spaced therefrom by a closely packed pulverulent refractory, the device having a free end and a confined end, both being substantially flat surfaces, the confined end being connected to an electrical connector means, such that the free end is at a known predetermined distance from the hot face of the refractory and the confined end extends a known distance beyond the steel shell, (b) connecting the confined end by means of the connector means to an electronic instrument capable of generating and impressing fast-rise timed pulses in the device and receiving and displaying pulses reflected by physical features of the device, (c) adjusting the length of the device on the display using reflected pulses appearing as an inflection from the confined end as a reference point, the reflected pulses along the length of the device appearing as a substantially straight line and the reflected pulses from the free end appearing as an inflection and showing the termination of the device, (d) sending timed pulses through the device and displaying the reflected pulses, and (e) determining the thickness of the refractory from the length of the straight line displayed on the instrument.

2. The method of claim 1 in which the central conductor in the monitor device is at least one metal taken from the group consisting of stainless steel, molybdenum, iron, platinum tungsten, and nickel base alloy containing manganese and aluminum and nickel base alloys containing chromium.

3. The method of claim 2 in which the electrical conductor is molybdenum.

4. The method of claim 1 in which the sheath of the device is at least one metal taken from the group consisting of stainless steel and molybdenum.

5. The method of claim 4 in which the conductor of the device is at least one metal taken from the group consisting of metal base alloys containing chromium and molybdenum and the sheath of the device is stainless steel.

6. The method of claim 1 in which the electrically insulating refractory material of the device is at least one refractory taken from the group consisting of: high purity alumina, mullite, sillimanite, chromite, lime, magnesia, calcined dolomite, silica and zirconia.

7. The method of claim 6 in which the electrically insulating refractory material of the device is high purity alumina.

8. The method of claim 6 in which the electrically insulating refractory material of the device is magnesia.

9. The method of claim 5 in which the electrically insulating refractory material of the device is high purity alumina.

10. The method of claim 5 in which the electrically insulating refractory material of the device is magnesia.

11. The method of claim 1 in which at least one of the monitoring devices is laid-up in the refractory in the interior of a blast furnace.

12. The method of claim 1, in which at least one of the monitoring devices is laid-up in the refractory in the interior of an electric furnace.

13. The method of claim 1, in which at least one of the monitoring devices is laid-up in the refractory in the interior of a basic oxygen furnace.

14. In an improved method for measuring the thickness of a refractory laid-up against the interior surface of the steel shell of a metallurgical apparatus comprising:

(a) placing at least one monitoring device of predetermined length comprised of a central metallic conductor coaxial with a metallic sheath and spaced therefrom by a closely packed pulverulent refractory, the device having a free end and a confined end, both being substantially flat surfaces, the confined end is contained in a junction box packed with an insulating material having a desired dielectric constant and is connected to an electrical connector means attached to the junction box, the conductor and sheath being separated by a material having a known dielectric constant in the junction box and being separated by the refractory at the free end of the device, such that the free end is at a known predetermined distance from the hot face of the refractory and the confined end extends a known distance beyond the steel shell, (b) connecting the confined end by means of the connector means to an electronic instrument capable of generating and impressing fast-rise timed pulses in the device and receiving and displaying pulses reflected by physical features of the device, (c) adjusting the length of the device on the display using reflected pulses appearing as an inflection from the confined end as a reference point, the reflected pulses along the length of the device appearing as a substantially straight line and the reflected pulses from the free end appearing as an inflection and showing the termination of the device, (d) sending timed pulses through the device and displaying the reflected pulses, and (e) determining the thickness of the refractory from the length of the straight line displayed on the instrument.

15. The method of claim 14 in which the central conductor in the monitor device is at least one metal taken from the group consisting of stainless steel, molybdenum, iron, platinum, tungsten, and nickel base alloy containing manganese and aluminum and nickel base alloys containing chromium.

16. The method of claim 15 in which the electrical conductor is molybdenum.

17. The method of claim 14 in which the sheath of the device is at least one metal taken from the group consisting of stainless steel and molybdenum.

18. The method of claim 17 in which the conductor of the device is at least one metal taken from the group consisting of molybdenum and nickel base alloys containing chromium and the sheath of the device is stainless steel.

19. The method of claim 14 in which the electrically insulating refractory material of the device is at least one refractory taken from the group consisting of: high purity alumina, mullite, sillimanite, chromite, lime magnesia, calcined dolomite, silica and zirconia.

20. The method of claim 19 in which the electrically insulating refractory material of the device is high purity alumina.

21. The method of claim 19 in which the electrically insulating refractory material of the device is magnesia.

22. The method of claim 18 in which the electrically insulating refractory material of the device is high purity alumina.

23. The method of claim 18 in which the electrically insulating refractory material of the device is magnesia.

24. The method of claim 14 in which at least one of the monitoring devices is laid-up in the refractory in the interior of a blast furnace.

25. The method of claim 14 in which at least one of the monitoring devices is laid-up in the refractory in the interior of an electric furnace.

26. The method of claim 14 in which at least one of the monitoring devices is laid-up in the refractory in the interior of a basic oxygen furnace.

* * * * *

UNITED STATES PATENT AND TRADEMARK OFFICE

CERTIFICATE OF CORRECTION

PATENT NO. : 4,269,397

DATED : May 26, 1981

INVENTOR(S) : Robert A. Strimple et al.

It is certified that error appears in the above-identified patent and that said Letters Patent are hereby corrected as shown below:

Col. 1, line 20, "sheel" should read -shell--.

Col. 1, line 36, "expanded" should read --expended--.

Col. 5, line 1, "electric" should read --dielectric--.

Col. 5, line 20, "tupes" should read --types--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*